US006343444B1

(12) United States Patent
Minami

(10) Patent No.: US 6,343,444 B1
(45) Date of Patent: Feb. 5, 2002

(54) PLUMBING DEVICE FOR PLUMBING AND CONNECTION OF A LONG MEMBER

(75) Inventor: Tatsusei Minami, Hirakata (JP)

(73) Assignees: Kabushiki Kaisha Matsumotokoumuten; Matsumura-gumi Corporation, both of Osaka (JP)

( * ) Notice: Subject to any disclaimer, the term of this patent is extended or adjusted under 35 U.S.C. 154(b) by 0 days.

(21) Appl. No.: 09/664,538

(22) Filed: Sep. 18, 2000

(30) Foreign Application Priority Data

Sep. 24, 1999 (JP) ..... 11-271060

(51) Int. Cl.[7] ..... B66F 3/46

(52) U.S. Cl. ..... 52/122.1; 52/126.1; 52/126.3; 52/125.6; 52/749.1; 52/DIG. 1; 52/127.5; 254/42; 254/104

(58) Field of Search ..... 52/122.1, 111, 52/125.1, 125.2, 125.3, 126.1, 126.3, 125.6, 127.5, 127.6, 749.1, DIG. 1; 254/42, 104

(56) References Cited

U.S. PATENT DOCUMENTS 459,071 A * 9/1891 Mowers ..... 254/104
1,832,394 A * 11/1931 Holmboe ..... 52/749.1
2,248,715 A * 7/1941 Mafera ..... 254/42
2,604,284 A * 7/1952 Arp ..... 52/DIG. 1
3,278,158 A * 10/1966 Saldana ..... 52/749.1
3,512,325 A * 5/1970 Nichols ..... 254/104
3,774,352 A * 11/1973 Weber ..... 51/238
3,974,618 A * 8/1976 Cortina ..... 52/745
4,400,920 A * 8/1983 Logsdon ..... 52/221
5,029,427 A * 7/1991 Jewett ..... 52/749.1
5,611,514 A * 3/1997 Oliver et al. ..... 248/357
5,867,950 A * 2/1999 Claisse ..... 52/125.6

* cited by examiner

*Primary Examiner*—Carl D. Friedman
*Assistant Examiner*—Phi Dieu Trana
(74) *Attorney, Agent, or Firm*—Rader, Fishman & Grauer, PLLC

(57) ABSTRACT

Provided is a plumbing device for plumbing and connection of a long member, at the time of installation vertically of the long member on an upper end of a lower member, which is used for plumbing the installed long member to connect with the lower member. The device includes a pair of splice plates to be attached onto both sides of a first and a second erection pieces and to be joined and fixed to the pieces, the first erection piece being arranged near the upper end of the lower member and the second erection piece near a lower end of the upper long member; a first wedge piece, to be inserted into a gap space made by the splice plates and the first and the second erection pieces, while slidably in contact with and supported by either the first or the second erection piece; a push-up piece, in the same gap space, to be located adjacent to the erection piece not in contact with nor supporting the first wedge piece, while supported by one of the splice plates so that vertical movement may be possible to be in contact with the adjacent erection piece; and a second wedge piece, for a fine adjustment, to be arranged between the first wedge piece to be inserted in the gap space and the push-up piece to be located in the same gap space, in a direction to cross the inserted first wedge piece, through the pair of the splice plates.

10 Claims, 7 Drawing Sheets

PLUMBING DEVICE FOR PLUMBING AND CONNECTION OF A LONG MEMBER

The invention is based on patent application Ser. No. 11-271060 Pat. filed in Japan, the contents of which are hereby incorporated by reference.

BACKGROUND OF THE INVENTION

1. Field of the Invention

The present invention relates to a plumbing device for plumbing and temporary connection of a long member until permanent connection is made. The device is used, in a place like a construction site of a structure, at the time of vertical installation of a long member, like a column member such as a steel column, or another long member, for plumbing the long member, installed almost vertically, i.e., almost in a direction perpendicular to a horizontal surface, on a lower member arranged on a foundation like a ground, or installed almost vertically on a lower column member arranged vertically, i.e., in a direction perpendicular to a horizontal surface.

2. Description of the Background Art

A long member is first installed almost vertically on a lower column member, in case of installation of a long member like a column member such as a steel column, or another long member, vertically on a lower column member, in a place like a construction site of a structure. Next, plumbing work is performed upon completion of temporary connection of the upper long member and the lower column member.

In the prior art of plumbing, wires are extended downwards in four (4) different directions from near the uppermost portion of the upper long member. Plumbing work is done by applying tension to the four (4) wires with tensioners. The upper long member is kept vertical in this manner until permanent connection is made with the lower column member.

Long time, however, is required for putting and removing wires and tensioners by the plumbing method where wires are used. Also, many temporary materials are needed including wires and tensioners.

Furthermore, wires extended in four (4) different directions tend to interfere with another wire for a different plumbing operation simultaneously performed in many cases, leading to disturbance of the total activities in a construction site and causing inefficiency of work.

Plumbing with wires may require re-plumbing as maintenance of verticality of a long member may not be possible due to elongation of a wire or relaxation of a tensioner, as long time is required before the long member is permanently connected. Also, removal of the plumbing device requires much time and work, after the long member is permanently connected.

SUMMARY OF THE INVENTION

Accordingly, an object of the invention is to provide a plumbing device for plumbing and connection of a long member, at the time of installation vertically of the upper long member on an upper end of a lower member, which is used for plumbing the installed long member to connect with the lower member, and particularly an inexpensive plumbing device with simplified structure which allows easy plumbing of the long member within a short time period without disturbing any other construction activity.

Another object of the invention is to provide a plumbing device for plumbing and connection of a long member, at the time of installation vertically of the long member on an upper end of a lower member, which is used for plumbing the installed long member to connect with the lower member, and particularly a plumbing device which can easily be removed within a short time period upon completion of permanent connection of the upper long member with the lower member.

The invention provides a plumbing device for plumbing and connection of a long member, at the time of installation vertically of the long member on an upper end of a lower member, which is used for plumbing the installed long member to connect with the lower member, including

- a pair of splice plates to be attached onto both sides of first and second erection pieces and to be joined and fixed to the pieces, the first erection piece being arranged on a side near the upper end of the lower member and the second erection piece being arranged in a location corresponding to that of the first erection piece on a side near the lower end of the upper long member,
- a first wedge piece to be inserted, in parallel with the splice plates, into a gap space made by the splice plates and first and second erection pieces, while slidably in contact with and supported by either the first or the second erection piece,
- a push-up piece, in the same gap space, to be located adjacent to the erection piece not in contact with nor supporting the first wedge piece, while supported by at least one of the splice plates in such a manner that vertical movement is allowed to be in contact with the adjacent erection piece, and
- a second wedge piece, for a fine adjustment, to be vertically movably arranged between the first wedge piece to be inserted in the gap space and the push-up piece to be located in the same gap space, in a direction to cross the inserted first wedge piece, through the pair of the splice plates.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
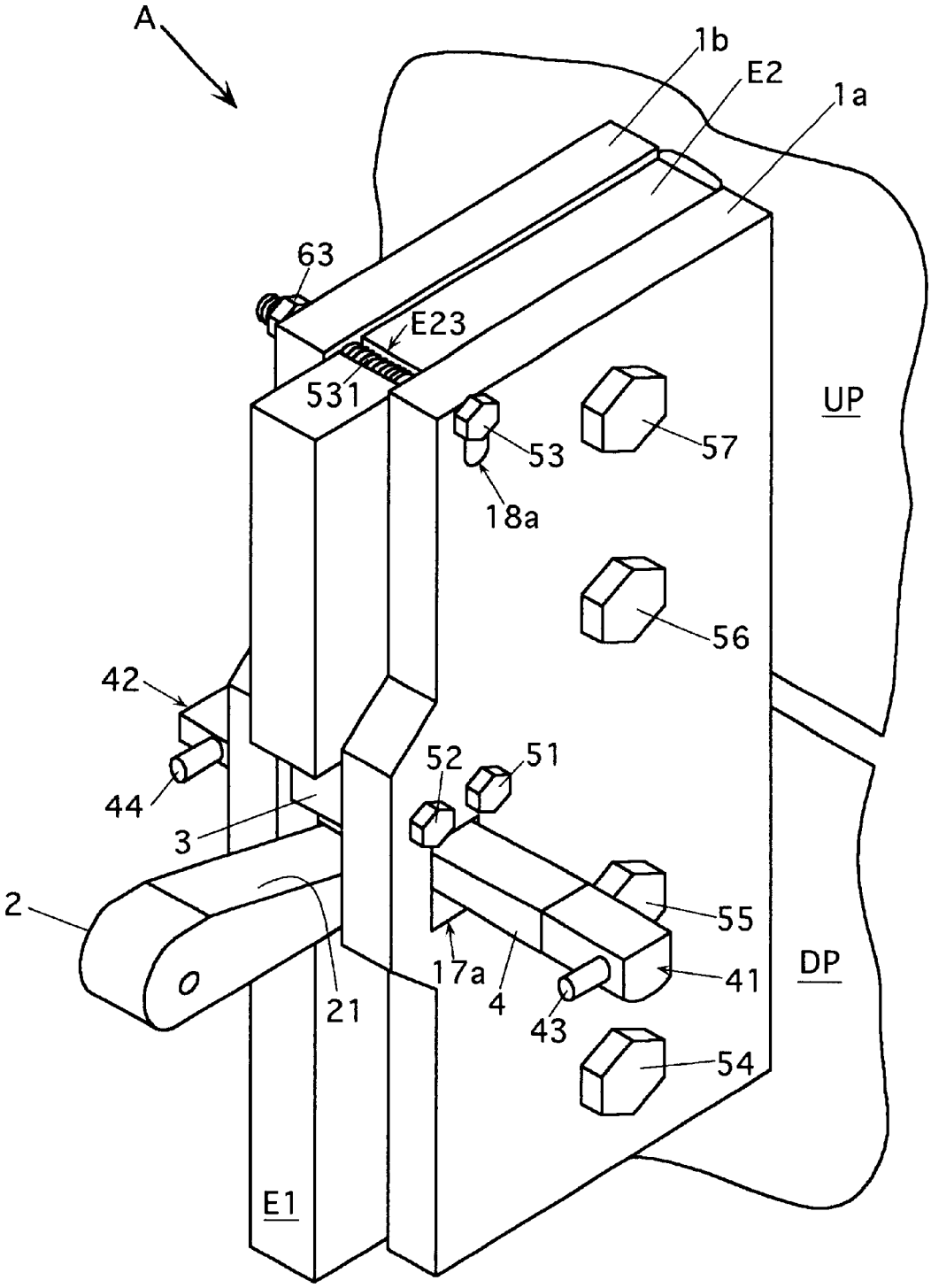
FIG. 1 is a perspective view showing the plumbing device for connection of a long member according to the invention actually in use.
Figure 2:
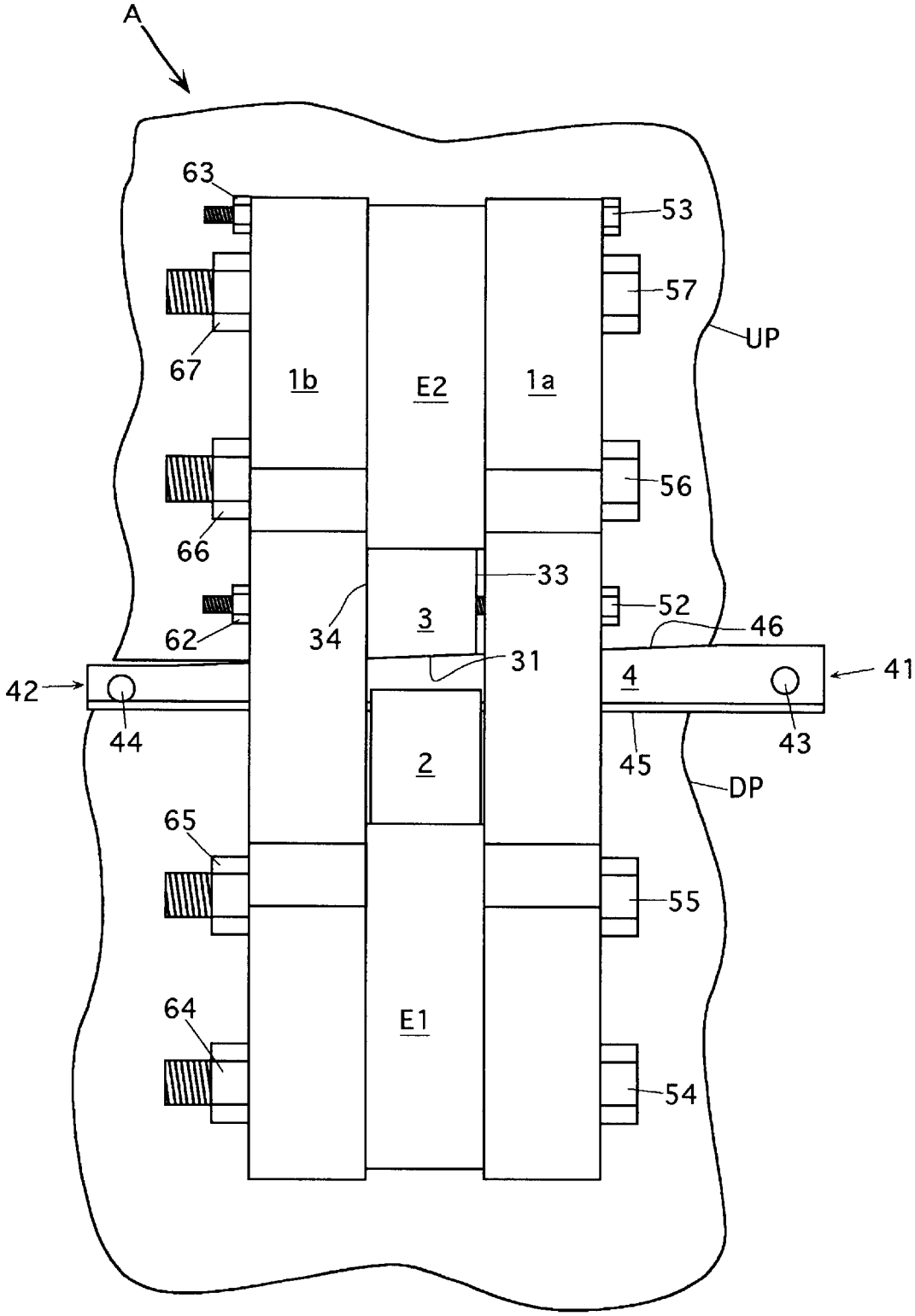
FIG. 2 is an elevation of the plumbing device for connection of a long member shown in FIG. 1.
Figure 3:
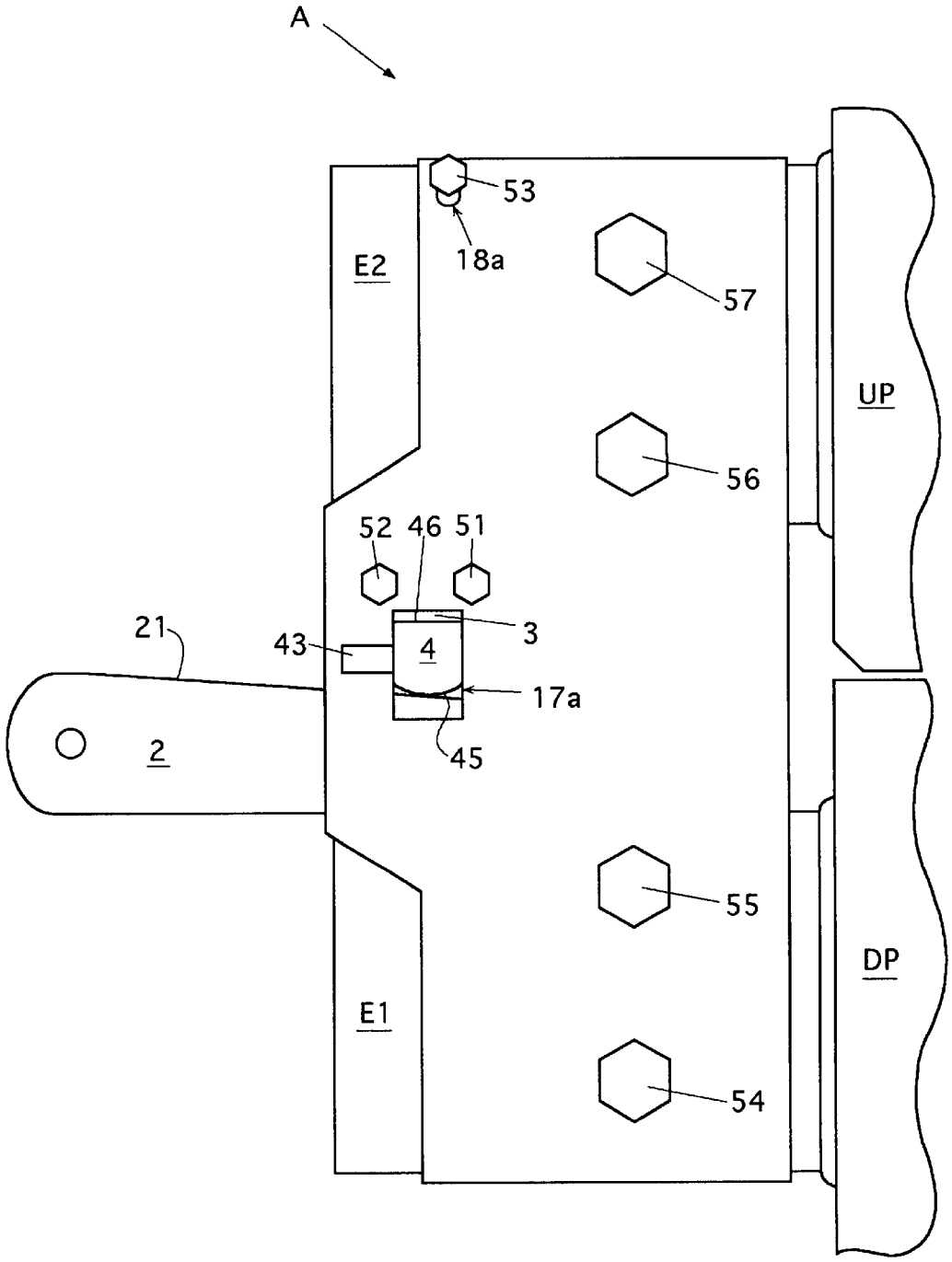
FIG. 3 is a side view of the plumbing device for connection of a long member shown in FIG. 1.
Figure 4:
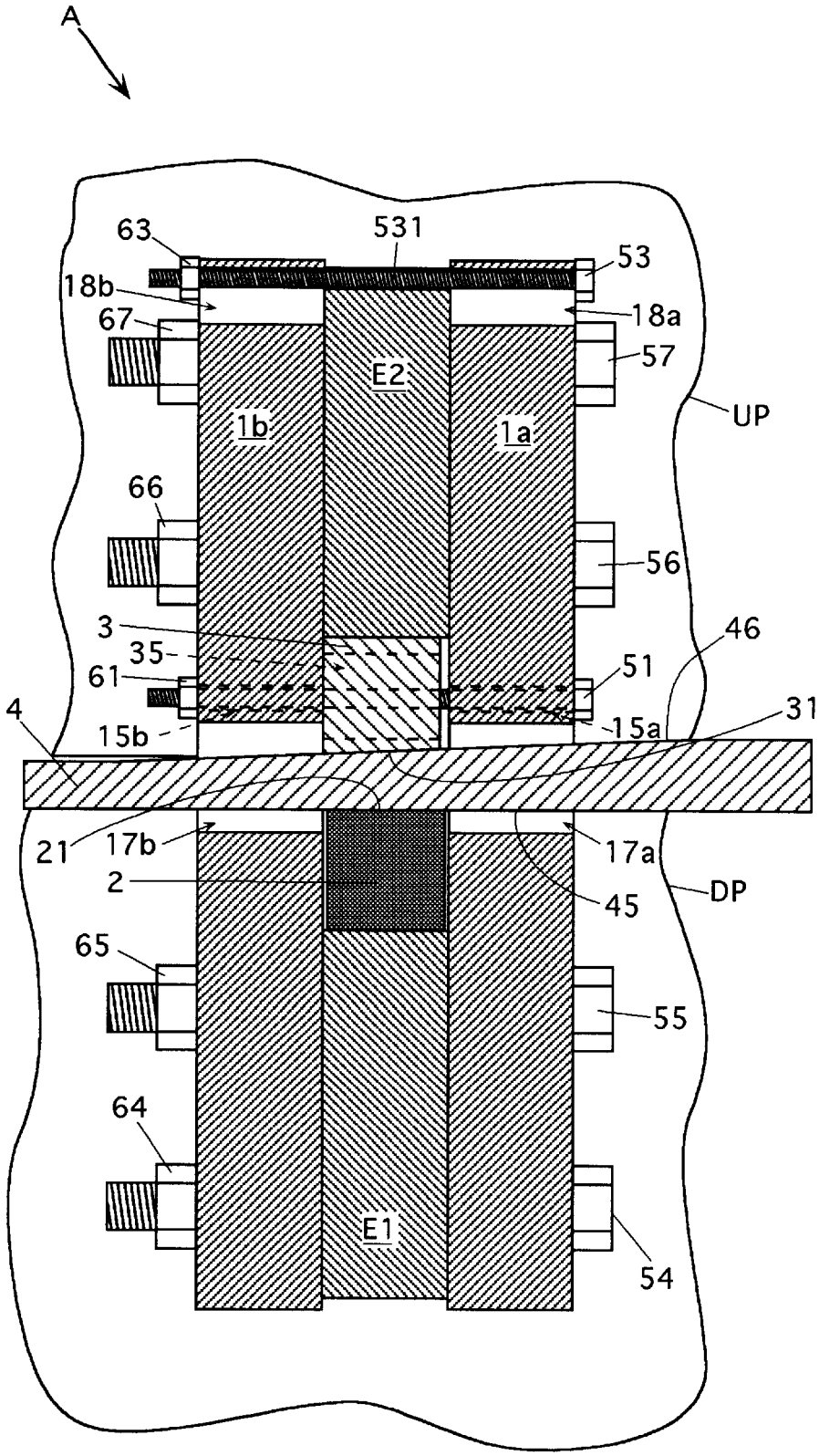
FIG. 4 is a cross sectional elevation of the plumbing device for connection of a long member shown in FIG. 1.

A preferred embodiment of a plumbing device for plumbing and connection of a long member according to the invention is a plumbing device for plumbing and connection of a long member, used, at the time of installation vertically of an upper long member on an upper end of a lower member, for plumbing the installed upper long member to be connected with the lower member.

The device includes a pair of splice plates. The pair of the splice plates should be attached onto both sides of first and second erection pieces and be joined and fixed to the pieces, the first erection piece being arranged on a side near the upper end of the lower member and the second erection piece being arranged in a location corresponding to that of the first erection piece on a side near the lower end of the upper long member.

The plumbing device for plumbing and connection of a long member furthermore includes, a first wedge piece to be inserted, in parallel with the splice plates, into a gap space made by the splice plates and first and second erection pieces, while sidably in contact with and supported by either the first or the second erection piece, a push-up piece, in the same gap space, to be located adjacent to the erection piece not in contact with nor supporting the first wedge piece, while supported by at least one of the splice plates so that vertical movement may be possible to be in contact with the adjacent erection piece, and a second wedge piece, for a fine adjustment, to be vertically movably arranged between the first wedge piece to be inserted in the gap space and the push-up piece to be located in the same gap space, in a direction to traverse the inserted first wedge piece, through the pair of the splice plates.

The plumbing device for plumbing and connection of a long member is used, for example, in a manner described below.

The push-up piece is arranged, before the device is used, to be supported by at least one of the splice plates so that vertical movement may be possible. The second wedge piece for a fine adjustment is arranged adjacent to the push-up piece while through the pair of the splice plates.

Before the device is used, a first erection piece is arranged on a side near the upper end of the lower member and a second erection piece is arranged on a side near the lower end of the upper long member.

It is not required but desired to have four (4) pairs of first and second erection pieces, on the sides of lower and upper members, approximately 90 degrees circumferentially apart each other.

Out of the upper long member and the lower member to be connected each other, the upper long member is lifted with a crane or the like and located over the lower member. At the time, the first erection piece on the lower member and the second erection piece on the upper long member are arranged in corresponding locations.

The plumbing device may be pre-assembled, with the exception of the first wedge piece, and may temporarily be engaged with the erection piece of the lifted upper long member in a manner where locationing of the upper long member over the lower member is not disturbed.

After that, the pair of splice plates are attached onto both sides of each pair of first and second erection pieces so that the splice plates may hold the erection pieces therebetween and are temporarily fixed to the erection pieces. This time, the push-up piece is arranged adjacent to the second erection piece (or the first erection piece). The push-up piece and (or) the second wedge piece may be arranged on the splice plates, after the splice plates are temporarily fixed to the first and the second erection pieces. Prior arranging on the splice plates, however, allows easier handling.

The pair of splice plates are temporarily fixed to the first and the second erection pieces this way, temporarily connecting the lower member and the upper long member and making the upper long member stand on the lower member.

Next, with a verticality measuring device like a plumb, a tilt of the upper long member off the vertical line is measured. When the tilt is found out, the first wedge piece(s) is hammered-in, in appropriate sequence, in one or more of the plumbing devices on the circumferential sides of the upper and lower members to be connected. By so doing, the second erection piece(s) is pushed up by the first wedge piece(s) via the push-up piece(s) and the second wedge piece(s), and the lower end portion of the upper long member, which has the second erection piece(s), is erected. Plumbing is thus done.

The upper long member is adjusted into vertical position by hammering-in one or more of the first wedge pieces in appropriate sequence this way. Furthermore, a fine adjustment of the upper long member is possible to verticality by hammering-in one or more of the second wedge pieces in appropriate sequence, if necessary. The upper long member is thus finally placed in a vertical position.

Next, each pair of splice plates are firmly fixed to the corresponding pair of first and second erection pieces. The lower member and the upper long member are thus firmly connected on a temporary basis.

Before or after final connection of the upper and the lower members by welding or the like, each first wedge piece is loosened and taken out by slightly hammering out each second wedge piece and each pair of splice plates are finally taken off the first and the second erection pieces. The upper long member can thus be vertically connected with the lower member.

As described above, the plumbing device for plumbing and connection of a long member makes easier and less time-taking plumbing possible that less disturbs other construction activities, compared with a conventional method of plumbing an upper long member with wires and tensioners. Furthermore, safe plumbing work is possible. Also, the plumbing device for plumbing and connection of a long member is of simple structure and can be provided at a lower cost.

The plumbing device for plumbing and connection of a long member can easily be removed in a short time period upon completion of final connection of the lower member and the upper long member.

For example, the push-up piece above may have a vertically long hole from one side, which faces one of the splice plates, through the other side. The push-up piece can be supported by the pair of splice plates with a bolt, in the long hole, supported by the splice plates at opposite ends thereof The push-up piece can thus move vertically.

The second wedge piece may be arranged through the pair of splice plates, for example, by making the piece loose-fit through the holes made on the splice plates. In this case, a fall-stopper may be arranged at each end of the second wedge piece outside the splice plate hole.

The fall-stoppers on the second wedge piece may be any one of those below or the like:

(1) pins that can be fitted into and taken out of pin-fitting holes made at opposite ends of the second wedge piece, (2) removable bolts or removable bolts with nuts engaged with bolt holes made at opposite ends of the second wedge piece, or (3) a curved portion, to avoid falling through the splice plate hole, formed as part of the wedge piece at the thicker end of the second wedge piece and a pin that can be fitted into and taken out of a pin- hole made at the other thinner end.

The portion of the second wedge piece to contact with the first wedge piece may have a cross section of an arc so that first to second wedge piece friction may be lowered at the time of plumbing operation.

The pair of splice plates may temporarily be engaged with a temporary engagement portion made at the outermost part on the upper end of the second erection piece, with an engagement rod arranged between the outermost parts, on the upper ends of the pair of splice plates, farther from the upper and the lower members to be connected.

The temporary engagement portion can, for example, be a concave portion made at the outermost part on the upper end of the second erection piece.

The plumbing device may be transported or stored as a pre-assembled package with the exception of the first wedge piece, or may be disassembled for separate transportation or storage.

The lower member may be a long member like a column or a connection member for vertical installation already installed on a foundation like a ground, a long member like a column already vertically installed, or the like.

A method of joining and fixing the pair of splice plates and the first and the second erection pieces is, for example, joining and fixing the splice plates and the erection pieces with bolts and nuts.

It is desired that high-tensile steel material should be used for making those included in the plumbing device, such as the first and the second wedge pieces, the push-up piece, the splice plates, and bolts and nuts for joining and fixing the splice plates and the erection pieces, as heavy load is applied.

Next, specific examples are described with reference to drawings of the plumbing device for plumbing and connection of a long member.

FIG. 1 is a perspective view showing an example of actual use of the plumbing device for plumbing and connection of a long member. To be more specific, the figure is a perspective view showing the device in use to vertically connect an upper column member onto an upper end of a lower column member already installed in a vertical direction.

FIG. 2, FIG. 3, FIG. 4, and FIG. 5 are an elevation, a side view, a cross sectional elevation and a cross sectional side view of the central part, respectively, of the plumbing device shown in FIG. 1, actually in use.

The plumbing device A for plumbing and connection of a long member includes a pair of splice plates 1*a* and 1*b*. The splice plates should be attached onto both sides of the first and the second erection pieces E1 and E2, and be joined and fixed to the pieces E1 and E2. The first erection piece E1 is connected, by a connecting method like welding, to a side near the upper end of the lower column member DP, already installed in a vertical direction, and the second erection piece E2 is connected, by a connecting method like welding, to a side near the lower end of the upper long member UP.

The device A furthermore includes a first wedge piece 2 which is inserted into a gap space S (See FIG. 5.) made by the pair of splice plates 1*a* and 1*b* and also by the first and the second erection pieces E1 and E2, while slidably in contact with and supported by the first erection piece E1. The device A also includes a push-up piece 3 to be located adjacent to the erection piece E2 and a second wedge piece 4 which is arranged between the first wedge piece 2 and the push-up piece 3.

A concave portion E23 (FIG. 5) is formed, for temporary engagement with the plumbing device, at the outermost part on the upper end of the second erection piece E2, farther from the upper long member UP.

Figure 6:
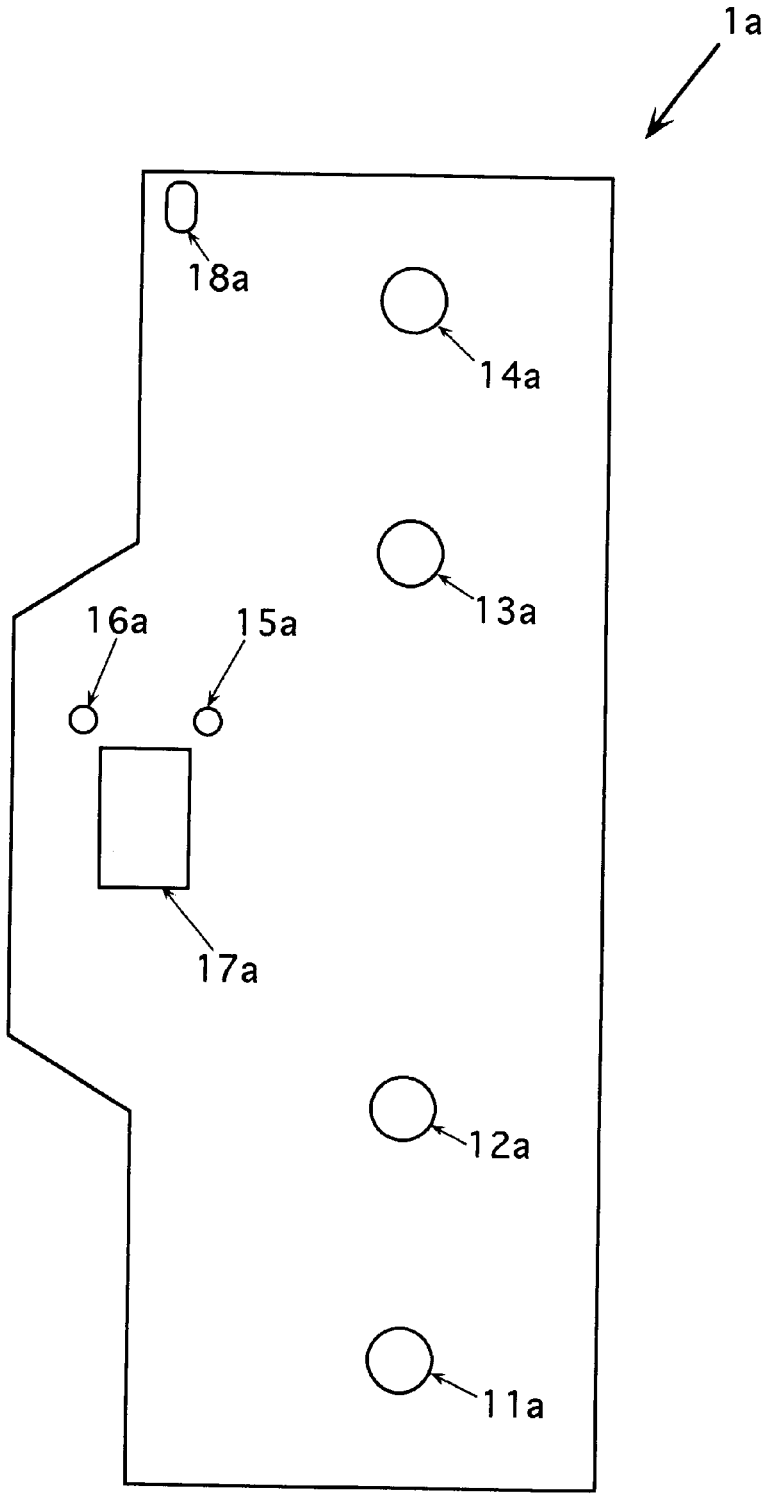
FIG. 6 is a side view of a splice plate of the device shown in FIG. 1.

The splice plate 1*a* is, as shown in the FIG. 6, rectangular, seen from the side, and is a flat plate with a trapezoid protruding from one of the longer edges in a vertical direction. The splice plate 1*a* is provided with, for connection with the erection pieces E1 and E2, four (4) bolt holes 11*a*, 12*a*, 13*a* and 14*a*.

Figure 5:
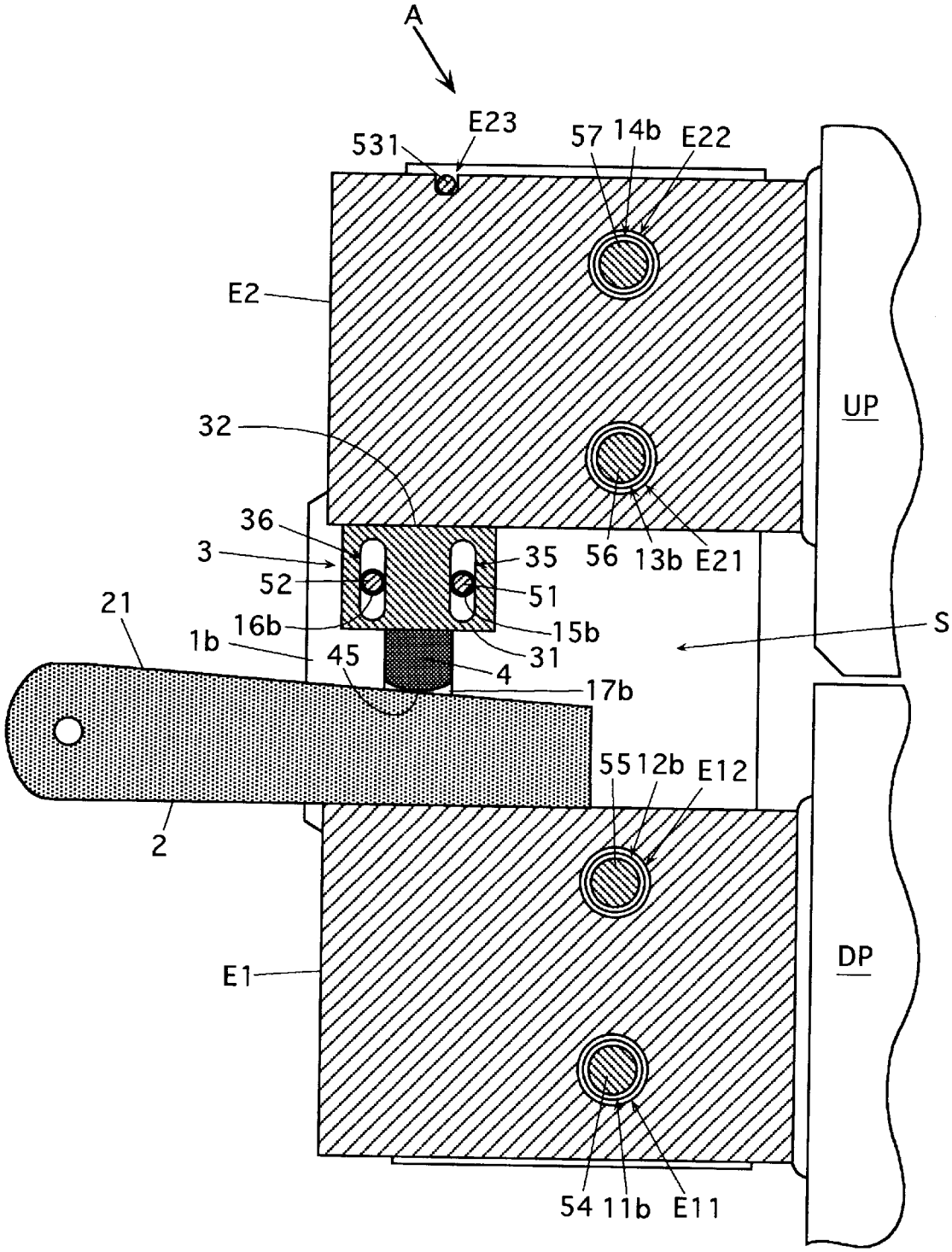
FIG. 5 is a cross sectional side view of the central part of the plumbing device for connection of a long member shown in FIG. 1.

The splice plate 1*b* is a flat plate, too, of geometry identical with the splice plate 1*a*, and is provided with bolt holes 11*b*, 12*b*, 13*b* and 14*b*, like the plate 1*a* (See FIG. 5.). The splice plates 1*a* and 1*b* are both provided with through holes 15*a* and 16*a* (See Fig. 6.), and 15*b* and 16*b* (See FIG. 4 and FIG. 5.) in respective locations corresponding to the push-up piece 3. The splice plates also have rectangular through holes 17*a* and 17*b* (See FIG. 4 and FIG. 6.), in respective locations corresponding to the second wedge piece 4.

Long holes 18*a* and 18*b* (See FIG. 4.), long in a vertical direction, are formed, for temporary engagement, on the portions of the splice plates 1*a* and 1*b*, corresponding to the concave portion E23 at the outermost part on the upper end of the erection piece E2.

The push-up piece 3 is of a short wedge shape. The push-up piece 3 has a flat upper surface 32 to contact with a flat lower end surface of the second erection piece E2. The piece also has a sloped bottom surface 31 to go down from a side 33 of the push-up piece 3 to another side 34 between a pair of the splice plates.

The push-up piece 3 furthermore has a pair of long holes 35 and 36, long in a vertical direction, through from the side 33 to the side 34 and parallel each other. With bolts 51 and 52 going through the through holes 15*a* and 15*b*, and 16*a* and 16*b*, respectively, on a pair of the splice plates, and also through the long holes 35 and 36 respectively, the push-up piece 3 is connected with the pair of splice plates 1*a* and 1*b*. The bolts 51 and 52 can be removed from the through holes 15*a* and 15*b*, and 16*a* and 16*b*, respectively. The push-up piece can vertically move as connected with the splice plates and can be taken off the plates. The bolt 51 has a nut 61 engaged at an end and the bolt 52 has a nut 62 engaged at an end, and thus the bolts are prevented from falling.

The second wedge piece 4 is arranged loose-fit with the rectangular through holes 17*a* and 17*b* going through the pair of splice plates. The second wedge piece 4 can vertically move as fit. The second wedge piece 4 is arranged between the first wedge piece 2 and the push-up piece 3, perpendicular to the first wedge piece 2, to have sidable contacts with both of the pieces 2 and 3. Holes for pins are formed at the ends 41 and 42 of the second wedge piece 4, outside the splice plates 1*a* and 1*b*, respectively. Pins 43 and 44 are put in those holes in a removable manner to prevent the piece 4 from falling out of the through holes 17*a* and 17*b*.

The bottom surface 45 of the second wedge piece 4, to contact with the first wedge piece 2, has a cross section of an arc. (See figures such as FIG. 2, FIG. 3 and FIG. 5.)

The slope angle of the bottom surface of the push-up piece 3 is almost identical with that of the upper surface of the second wedge piece 4. The slope angle is less than that of the upper surface 21 of the first wedge piece 2, to contact with the bottom surface 45 of the second wedge piece 4.

Bolt 53 is put through the long holes 18*a* and 18*b* for temporary engagement, located at the upper ends of the splice plates. Nut 63 is engaged with an end of the bolt 53 in a removable manner. This way, a temporary engagement portion is formed to temporarily engage the plumbing device A with the above concave portion E23 at the outermost part on the upper end of the second erection piece E2. That is, bolt 53, part 531 of the bolt 53 to be specific, is the very portion for temporary engagement.

Storage, transportation or the like of the device A is possible, whether it be totally disassembled to members or with the members almost totally connected and assembled, as the members of the device A, except the first wedge piece 2, are connected by removable connecting means, or by engaging removable fall-stopper pins. With more members connected, the device A can be handled much more easily for storage, transportation or plumbing.

Round holes E11 and E12, and E21 and E22 (See FIG. 5.) are formed on the first and the second erection pieces E1 and E2, respectively. The diameter of those is larger than that of the bolt holes 11*a*~14*a* and 11*b*~14*b* on a pair of splice plates 1*a* and 1*b*, respectively.

The upper surface (slope surface) 46 of the second wedge piece 4 contacts with the slope surface 31 of the push-up piece 3 in the plumbing device A. Also, the upper surface (slope surface) 21 of the first wedge piece 2 contacts with the bottom surface 45 of the second wedge piece 4 to have the cross section of an arc.

As the first wedge piece 2 is inserted deeper, it goes under the second wedge piece 4, and, at the same time, the second wedge piece 4 is pushed upward. The slopes 46 and 31 of the second wedge piece 4 and the push-up piece 3 are in a direction perpendicular to the motion of the first wedge piece 2. The second wedge piece 4, therefore, pushes up the push-up piece 3 by the amount it is pushed up by the first wedge piece 2. As a result, the push-up piece 3, supported by a pair of splice plates 1*a* and 1*b*, in a manner where vertical motion is allowed, is pushed up. The pushed up push-up piece 3 pushes the second erection piece E2, to perform plumbing.

An example of the process follows for plumbing the upper column member UP, having a circular or quadrilateral cross section, on the lower column member DP, having an identical shape of cross section, with the plumbing device A.

First, the first erection pieces E1 are fixed in advance in four (4) locations, apart each other by an equal central angle (90 degrees), on the sides near the upper end of the lower column member DP. The second erection pieces E2 are also fixed in advance corresponding to erection pieces E1, on the sides near the lower end of the upper column member UP.

Next, the upper column member UP is lifted with a lifting device like a crane. At the same time, or, before or after that, bolt 53 is put through holes 18*a* and 18*b*, from 18*a* through 18*b*, long holes for temporary engagement formed on the splice plates of each assembly of a pair of the splice plates 1*a* and 1*b*, the push-up piece 3, and the second wedge piece 4, pre-assembled according to the process given above. Nut 63 is engaged with the protruding end of the bolt 53. The bolt 53 is used as a rod for temporary engagement in this manner. The bolt 53 may be put through beforehand.

Also, bolt 56 is put through bolt holes 13*a* (See FIG. 6.) and 13*b* (See FIG. 5.) on the splice plates 1*a* and 1*b*, respectively, from 13*a* through 13*b* so that an end of the bolt 56 may protrude from the hole 13*b* and nut 66 may be engaged with the end.

Figure 7:
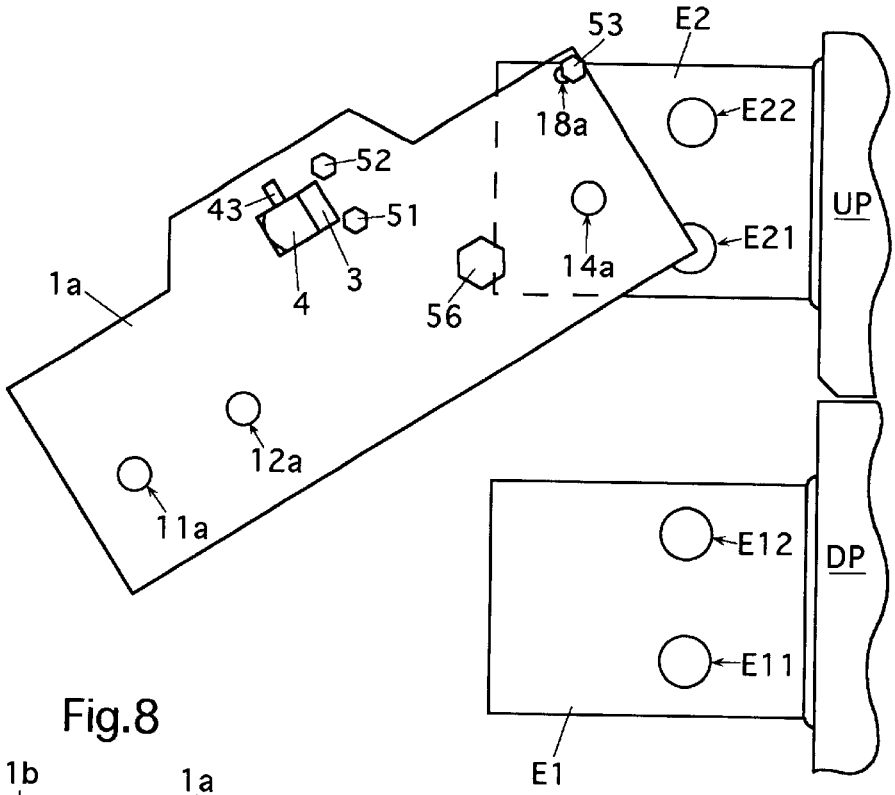
FIG. 7 is a side view of the plumbing device for plumbing and connection of a long member shown in FIG. 1 temporarily engaged with an upper erection piece.
Figure 8:
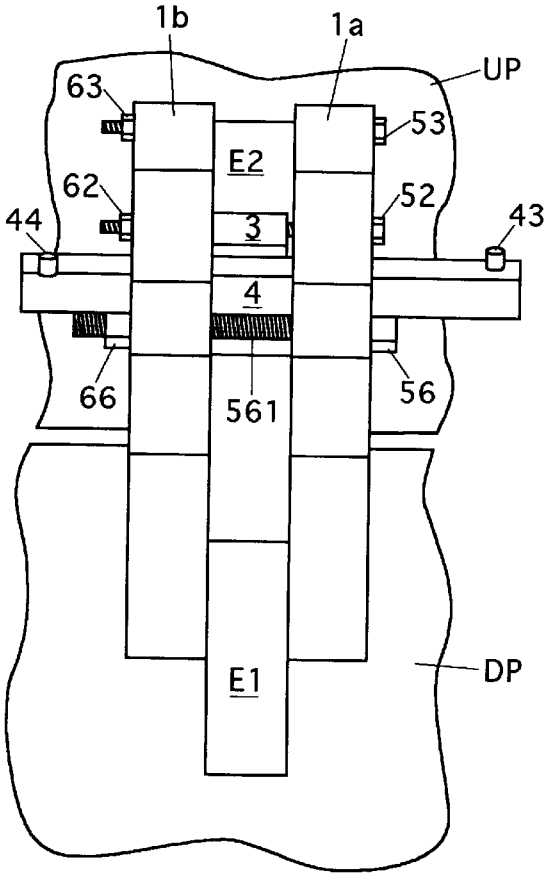
FIG. 8 is an elevation of the plumbing device for plumbing and connection of a long member shown in FIG. 1 temporarily engaged with the upper erection piece.

Under the condition, the portion 531 (See FIG. 4.), between the splice plates 1*a* and 1*b*, of the bolt 53, i.e., a shaft for temporary engagement, is engaged with the concave portion E23 (See FIG. 1.), at the outermost part on the upper end of the upper erection piece E2, as shown in FIG. 7 and FIG. 8. At the same time, the central portion 561 of the bolt 56 is brought into contact with the outer end surface of the erection piece E2 for a temporary arrangement.

With the plumbing device A temporarily engaged with the erection piece E2 as described above, the upper column member UP is further moved with a lifting device like a crane to be placed on the upper end of the lower column member DP. At this time, each of the corresponding first and second erection pieces E1 and E2 should be aligned. Next, the temporarily put bolt 56 is removed and the splice plates 1*a* and 1*b* are turned around with the bolt 53 as the turning center, so that the splice plates 1*a* and 1*b* may cover the erection pieces E1 and E2.

Bolt 54 is put through bolt hole 11*a* on the plate 1*a*, round hole E11 on the first erection piece E1 and bolt hole 11*b* on the plate 1*b*. Nut 64 is engaged with the end near the bolt hole 11*b* and is temporarily tightened. Bolt 55 is put through an upper bolt hole 12*a*, round hole E12 and bolt hole 12*b*. Nut 65 is used for temporary tightening. Similarly, bolt 56 is put through bolt hole 13*a*, round hole E21 and bolt hole 13*b*. Nut 66 is used for temporary tightening. Bolt 57 is put through bolt hole 14*a*, round hole E22 and bolt hole 14*b*. Nut 67 is used for temporary tightening. The upper column member UP is temporarily connected with the lower column member DP in this manner. The bolt 53, for temporary engagement, is removed after that.

Upon completion of the operations above, verticality of the upper column member UP is measured with a verticality measuring device like a plumb, so that tilt direction and the tilt angle of the upper column member UP may be detected.

Once the tilt is detected, the first wedge piece 2, of the plumbing device A, on the tilting side, is pushed in, which, in turn, pushes up the second wedge piece 4, the push-up piece 3 and the second erection piece E2, plumbing the upper column member UP. The operations are done, for example, by hammering-in the wedge piece 2 little by little and identical operations are done with the device(s) A arranged on other sides of the column member to finally put the upper column member UP in a vertical position. Also, fine adjustments are done, if required, using the second wedge piece(s) 4 having a smaller gradient than the first wedge piece 2.

After that, bolts 54, 55, 56 and 57 are further tightened, so that the upper column member UP may temporarily be fixed on the lower member DP maintaining verticality with friction force between pairs of the splice plates 1*a* and 1*b* and the first and the second erection pieces E1 and E2.

Finally, the lower column member DP and the upper column member UP are permanently connected by a method like welding and the plumbing devices A are all removed to complete the whole plumbing operations.

It is difficult to pull out the first wedge piece 2, as it is hammered in towards the members DP and UP in parallel with a pair of splice plates 1*a* and 1*b*. The second wedge piece 4, inserted in a direction perpendicular to the first wedge piece 2, therefore, is hit in a direction to be loosened, upon completion of plumbing operations, so that the first wedge piece 2, the second wedge piece 4 and the push-up piece 3 are all loosened and the first wedge piece 2 can be pulled out. The bolts 54, 55, 56 and 57 are taken out and each device A is removed.

In the plumbing device A for plumbing and connection of a long member described above, the first wedge piece 2 has contact with and is supported by the first erection piece E1 arranged on the lower member, the push-up piece 3 contacting the erection piece E2. On the contrary, however, the first wedge piece 2 may contact with the erection piece E2 and the push-up piece 3 may contact with and be supported by the erection piece E1. Sloping may be in the reverse direction of the push-up piece 3 and of the second wedge piece 4.

The plumbing device A for plumbing and connection of a long member described above is, though not restricted to, of high-tensile steel, as a heavy load and large moment are well anticipated on the device.

Each member, especially a splice plate, to compose the plumbing device A described above, has a large cross section and a short member length with respect to the direction of compression and/or tension, leading to a small quantity of distortion or deformation of the member. It is easier to maintain verticality of the upper column member with the device A than with wires or the like, due to the smaller amount of distortion or deformation.

Although the present invention has been described and illustrated in detail, it is dearly understood that the same is by way of illustration and example only and is not to be taken by way of limitation, the spirit and scope of the present invention being limited only by the terms of the appended claims.

What is claimed is:

1. A plumbing device for plumbing and connection of a long member, at the time of installation vertically of the long member on an upper end of a lower member, which is used for plumbing the installed long member to connect with the lower member, comprising:

a pair of splice plates to be attached onto both sides of first-and second erection pieces and to be joined and fixed to the pieces, the first erection piece being arranged on a side near the upper end of the lower member and the second erection piece being arranged in a location corresponding to that of the first erection piece on a side near a lower end of the upper long member;

a first wedge piece to be inserted, in parallel with the splice plates, into a gap space made by the splice plates and the first and the second erection pieces, while slidably in contact with and supported by either the first or the second erection piece;

a push-up piece, in the same gap space, to be located adjacent to the erection piece not in contact with nor supporting the first wedge piece, while supported by at least one of the splice plates in such a manner that vertical movement is allowed to be in contact with the adjacent erection piece; and a second wedge piece, for a fine adjustment, to be vertically movably arranged between the first wedge piece to be inserted in the gap space and the push-up piece to be located in the same gap space, in a direction to cross the inserted first wedge piece, through the pair of the splice plates.

2. The plumbing device for plumbing and connection of a long member according to claim 1, wherein the push-up piece has a vertically long hole from one side facing one of the splice plates through the other side, is supported by the pair of splice plates with a bolt, in the long hole, supported by the splice plates at opposite ends and is vertically movable.

3. The plumbing device for plumbing and connection of a long member according to claim 1, wherein the second wedge piece is arranged through the pair of splice plates by making the piece loose-fit through holes made on the splice plates, with a fall-stopper arranged at each end of the second wedge piece outside the splice plate hole.

4. The plumbing device for plumbing and connection of a long member according to claim 2, wherein the second wedge piece is arranged through the pair of splice plates by making the piece loose-fit through holes made on the splice plates, with a fall-stopper arranged at each end of the second wedge piece outside the splice plate hole.

5. The plumbing device for plumbing and connection of a long member according to claim 1, wherein a portion of the second wedge piece to contact with the first wedge piece has a cross section of an arc.

6. The plumbing device for plumbing and connection of a long member according to claim 3, wherein a portion of the second wedge piece to contact with the first wedge piece has a cross section of an arc.

7. The plumbing device for plumbing and connection of a long member according to claim 4, wherein a portion of the second wedge piece to contact with the first wedge piece has a cross section of an arc.

8. The plumbing device for plumbing and connection of a long member according to claim 1, wherein the pair of splice plates can temporarily be engaged with a temporary engagement portion made at an outermost part on an upper end of the second erection piece, with an engagement rod arranged between outermost parts, on upper ends of the pair of splice plates, farther from the upper and the lower members to be connected.

9. The plumbing device for plumbing and connection of a long member according to claim 4, wherein the pair of splice plates can temporarily be engaged with a temporary engagement portion made at an outermost part on an upper end of the second erection piece, with an engagement rod arranged between outermost parts, on upper ends of the pair of splice plates, farther from the upper and the lower members to be connected.

10. The plumbing device for plumbing and connection of a long member according to claim 7, wherein the pair of splice plates can temporarily be engaged with a temporary engagement portion made at an outermost part on an upper end of the second erection piece, with an engagement rod arranged between outermost parts, on upper ends of the pair of splice plates, farther from the upper and the lower members to be connected.

* * * * *